US006901989B1

(12) United States Patent
Sargent et al.

(10) Patent No.: US 6,901,989 B1
(45) Date of Patent: Jun. 7, 2005

(54) REMOVING LOST FOAM PATTERN COATING RESIDUE FROM A CASTING

(75) Inventors: Nicholas Edward Sargent, Canton, MI (US); June-Sang Siak, Troy, MI (US); Mei Cai, Bloomfield Hills, MI (US); Thomas C. Pederson, Rochester Hills, MI (US); Sheila Farrokhalaee Kia, Bloomfield Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/335,851

(22) Filed: Jun. 14, 1999

Related U.S. Application Data

(63) Continuation-in-part of application No. 08/919,907, filed on Aug. 28, 1997, now abandoned.

(51) Int. Cl.[7] ..... B22C 7/02; B22C 3/00
(52) U.S. Cl. ..... 164/34; 164/72; 164/131
(58) Field of Search ..... 164/14, 72, 34, 164/35, 36, 131

(56) References Cited

U.S. PATENT DOCUMENTS

| | | | | |
|---|---|---|---|---|
| 4,281,705 | A | 8/1981 | Jeney | 164/10 |
| 4,448,235 | A | 5/1984 | Biship | 164/34 |
| 4,482,000 | A | 11/1984 | Reuter | 164/34 |
| 5,387,280 | A | 2/1995 | Kennerknecht | 106/38.3 |

FOREIGN PATENT DOCUMENTS

| | | | |
|---|---|---|---|
| JP | 53-65221 | 6/1978 | |
| JP | 63290647 | 11/1988 | |
| JP | 5-104.198 | 4/1993 | 164/34 |

*Primary Examiner*—Kuang Y. Lin
(74) *Attorney, Agent, or Firm*—Kathryn A. Marra

(57) ABSTRACT

In the lost foam casting of aluminum, coating a fugitive pattern with a refractory coating containing a thermally stable, water-insoluble, acid-gasifiable (e.g. $CaCO_3$) compound, and contacting the casting, with the coating thereon, with an acid to dissociate and gasify the compound and rupture the coating. Preferably, any thermal degradation products from the pattern residing in the coating are neutralized to promote wetting of the coating.

13 Claims, 1 Drawing Sheet

REMOVING LOST FOAM PATTERN COATING RESIDUE FROM A CASTING

REFERENCE TO RELATED APPLICATIONS

Figure 1:
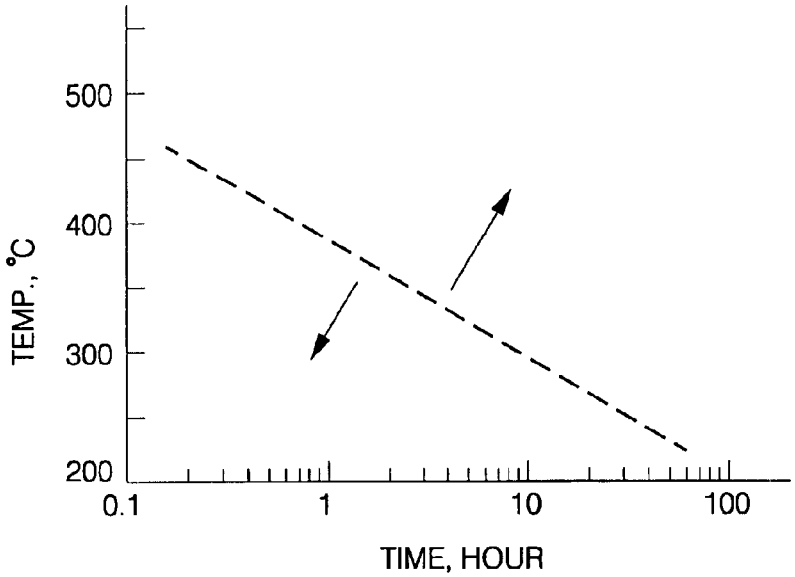

This is a continuation-in-part of Ser. No. 08/919,907 filed 28 Aug. 1997 now abondoned.

TECHNICAL FIELD

This invention relates to the lost foam process for making aluminum castings and more specifically to coating the lost foam pattern with a refractory coating that is readily acid-washed from the aluminum casting.

BACKGROUND OF THE INVENTION

This is a Continuation In Part application of co-pending United States patent application Ser. No. 08/919,907 filed Aug. 28, 1997 in the names of Nicholas, Edward Sargent, et al., and assigned to the assignee of the present invention.

The "lost foam" process is well known in the art, and involves principally the steps of: (1) preparing (e.g., molding) a pattern from a fugitive material such as expanded polystyrene (EPS) foam; (2) coating the pattern with a refractory coating (i.e., about 0.25 mm to about 1.5 mm thick) to stiffen the pattern, provide a barrier between the surface of the pattern and the sand, and control the metal fill rate; (3) drying the coating; (4) investing the pattern in a bed of unbonded sand to form a mold about the pattern; (5) pouring molten aluminum into the mold to vaporize and displace the pattern, and form a casting that replicates the shape of the pattern; and (6) removing the sand from around the casting. The casting may or may not be water quenched in the course of a heat treatment following casting depending on the particular aluminum alloy used and the desired final microstructure. For example, A319 aluminum alloys are frequently quenched in water in the course of a T-5 heat treatment to improve its machineability and dimensional stability.

EPS pattern coatings typically comprise water-based slurries (i.e., about 45–70% by weight solids) including various combinations of (1) refractories such as silica, alumina, chromite, mica, zircon, quartz, olivine, aluminosilicates or hollow glass microspheres, (2) binders such as clay and various polymers, (3) surfactants, (4) thixotropic agents, and (5) dispersants. On a dry basis, the coatings comprise about 80% to about 98% by weight refractory, about 0.5–18% by weight binders, and about 2% by weight surfactants/dispersants/and thixotropic agents. The permeability of the coating is controlled by the size and shape of the refractory particles and serves to control the rate at which liquid and gaseous pyrolysis products escape into the sand which, in turn, controls the rate at which the aluminum enters the mold. The coatings are most commonly applied by dipping the pattern therein, but may also be sprayed, brushed or pumped onto the pattern. Though water is the most common carrier for the refractories, other carriers that are compatible (e.g., a non-solvent) with the pattern may also be used.

Unfortunately, some residue from the refractory coating that is applied to the foam pattern adheres to the surface of the aluminum casting, and is difficult, time consuming and expensive to remove. This is particularly the case where the coating residue needs to be removed from the internal passages of complex castings such as internal combustion engine blocks or heads. Some known techniques for removing at least a portion of the coating residue include (1) thermally shocking the coating by plunging the hot casting into water immediately after casting, (2) shot blasting the casting (e.g., with plastic, steel or ceramic shot), (3) scrubbing the casting in an agitated aqueous slurry of abrasive particles, (4) rapping the casting with a hammer(s), (5) immersing the casting in a bath of ultrasonically agitated water, (6) blasting the casting with a stream of water or steam, and (7) dipping the casting in a bath of molten salt, or caustic soda.

SUMMARY OF THE INVENTION

The present invention is a simple process for readily and economically removing any of the pattern's refractory coating that adheres to an aluminum lost foam casting following removal of the sand. The invention is particularly advantageous in that it permits removal of the coating in areas of the casting (e.g. internal passages) inaccessible to traditional mechanical means for removing the coating. The invention contemplates (1) coating the foam pattern with a refractory coating containing a water-insoluble, acid-gasifiable compound that is thermally stable (i.e. won't decompose) at the casting temperature, and (2) following casting, contacting (e.g. dipping, spraying, etc.) the coated casting with an inorganic or organic acid-washing solution to dissociate the compound into a plethora of gas bubbles that effervesce and rupture the coating to facilitate its removal. The thermally stable, water-insoluble, acid-gasifiable compound will preferably comprise an inorganic carbonate, more preferably an alkaline earth carbonate (i.e. calcium, magnesium, strontium or barium carbonate), and most preferably calcium carbonate. Such carbonates are inexpensive and form soluble byproducts with the acid's anion, which further facilitates removal from the casting. Calcium carbonate will preferably be used in concentrations greater than about 10% by weight t of the coating, on a dry basis. The particle size of the calcium carbonate can be controlled and used as a means to control the speed/aggressiveness of the reaction. Calcium carbonate will preferably have a particle size less than about 5 microns to provide a large reaction surface for a very aggressive reaction.

Preferably, the casting will be immersed in a bath of the acid. In one embodiment, the acid treatment is for the sole purpose of removing the coating and the treatment may be done while the casting is either hot or cold. In another embodiment, i.e. where the casting needs to be quenched anyway as part of a heat treating operation, the quenchant (e.g. water) will be acidified such that coating removal is achieved at the same time that the hot casting is being quenched.

Virtually any acid may be used so long as it does not attack the surface of the casting, and may include weak acids such as acetic acid, or diluted strong acids such as phosphoric or hydrochloric acid, inter alia. Dilute phosphoric acid is preferred as it is less corrosive of surrounding equipment than many other acids, and yet is just as effective in removing the coating. Dissociation of the gasifiable compound is more rapid with the stronger acids than with the weaker acids. The acid will preferably have a pH less than about 2.5 for rapid dissociation of the compound and more aggressive rupture of the coating.

During casting, the EPS pattern thermally degrades and deposits a partially oxidized hydrophobic organic contaminant that impedes thorough wetting of the coating by the acid. According to a most preferred embodiment of the invention, the affects of the hydrophobic contaminant are neutralized. These affects can be neutralized by the addition of a surfactant to the acid which promotes better wetting of the coating residue and accelerates removal of the coating residue. Most preferably however, the casting is heat treated before immersion in the acid bath to remove the hydrophobic contaminant before immersing the casting in the acid.

DETAILED DESCRIPTION OF THE INVENTION

The invention will better be understood when considered in the light of the following detailed description of certain aspects thereof provided hereafter in connection with the preferred gasifiable additive, $CaCO_3$ and the following figures.

Figure 2:
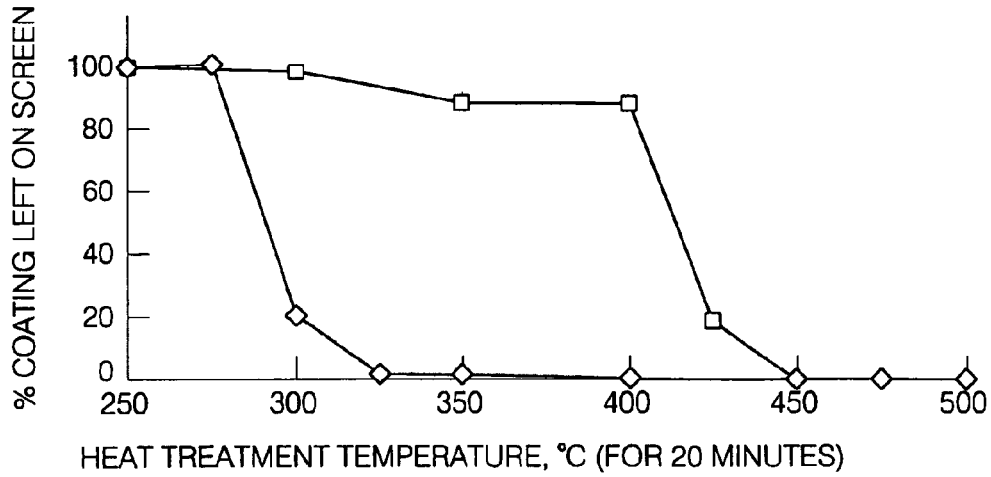

FIG. 1 is a plot of the heat treatment time-temperature relationship needed to remove the hydrochloric residue from the coating; and FIG. 2 shows plots of the heat treatment temperatures required to remove $CaCO_2$ containing coatings (i.e., by acid-dipping) with and without polystyrene degradation products present.

The refractory coatings of the present invention will preferably comprise about 10% or more, by weight dry of calcium carbonate. Below about 10%, there is insufficient carbonate for rapid, effective removal of the coating. The precise concentration of the gasifiable compound in the coating for any given situation will depend on which compound, which acid, and which acid concentration is used and can be determined by routine experimentation. The same is true for the concentration of the acid, which tests have shown can vary from concentrated to very dilute (i.e. as much as 100 parts water to 1 part acid). Accordingly, such concentrations are not part of the present invention.

Testing

A number of tests were conducted to demonstrate various aspects of the invention. 100 mesh wire screens were cut into test wafers 2 and 9/16 inch in diameter. The wafers were (1) dipped into several different coating slurries, (2) dried at 95° C for 90minutes, and (3) weighed. The slurries comprised mica-based commercial coatings from the Borden and Ashland companies (1) without a calcium carbonate addition, and (2) with the addition of ground up limestone (i.e. calcium carbonate) containing a small amount (i.e. about 1.5±%) of magnesium carbonate. In one series of tests, the dried coatings contained 20% by weight of the limestone. In other tests, different limestone concentrations were used. Some of the dried samples were also baked at 500° C. for 30 minutes to simulate the thermal conditions experienced during aluminum casting, and weighed again. The permeability of the baked and unbaked screens coated with the 20% $CaCO_3$ coating was then measured using a conventional foundry electric or floating drum permmeter such as described in "Innovations in Controlling the Lost Foam", Modern Casting, January 1996. Table I shows the results of those tests, to wit, that with coatings containing 20% by weight calcium carbonate, the permeabilities are unchanged as between the baked and unbaked samples.

TABLE I

Permeability of Screens (in AFS permeability units)

| | Dried | Baked at 500° C. |
|---|---|---|
| Coating without additive | 4.9 | 7.0 |
| Coating with 20% additive | 4.9 | 6.9 |

Samples of the same 20% $CaCO_3$-containing coated screens were then dipped in various wash solutions for 0.5 to 1 minute, dried and weighed. In the samples having the $CaCO_3$-containing coatings, vigorous bubbling occurred in the acid wash that disrupted the integrity of the coating. Table II shows the results of one such test, and specifically that, on a basis of the percentage of W the original coating removed, a coating containing 20% by weight calcium carbonate was removed 18 times more effectively when dipped in a dilute phosphoric (i.e. 1 part $H_3PO_4$ to 25 parts $H_2O$) wash solution than a coating containing no carbonate and dipped in the same wash solution, and almost 900 times more effectively than a carbonate-free coating dipped in a non-acidic wash solution.

TABLE II

Percent (by dry weight) of Coating Residue Removed by Wash Step

| | Water Wash | Add Wash (1:25 phosphoric acid) |
|---|---|---|
| Coating alone | 0.1 | 4.9 |
| Coating + carbonate material (added 20% of dry weight) | 0.1 | 88.7 |

Table II shows the percent of the 20% $CaCO_3$-containing coatings removed from the screens in phosphoric acid wash solutions having different $H_3PO_4$ concentrations. The data shows that 89% or more of the $CaCO_3$-containing coatings was removed with very dilute and concentrated wash solutions while only about 20% of the carbonate-free coatings were removed with only the most concentrated acid wash solutions.

TABLE III

Percent (by dry weight) of Coating Residue Removal using Different Acid Strengths

| Phosphoric acid Dilution | Coating alone | Coating + carbonate material (added as 20% of dry weight) |
|---|---|---|
| Concentrated | 20+ | 99+ |
| 1:10 | 20 | 93 |
| 1:25 | NA | 92 |
| 1:50 | 14 | 91 |
| 1:100 | 6 | 89 |

In another series of tests, the concentration of the $CaCO_3$ and the acid in the wash was varied. Table IV shows the effects of various concentrations of the carbonate in an acid-free wash, a wash containing 1 part $H_3PO_4$ to 25 parts $H_2O$, and a wash containing 1 part $H_3PO_4$ to 50 parts $H_2O$. That data shows that an acid-free wash has no effect on the coatings while significantly more of the coating is removed in the acid wash at calcium carbonate concentrations near 20% than at concentrations near 10% or less.

TABLE IV

Percent (by dry weight) of Coating Residue Removal using Various Carbonate Concentrations

| % of solids as carbonates | Water wash | Acid wash (1:25 phosphoric acid) | Acid wash (1:50 phosphoric acid) |
|---|---|---|---|
| 5% | 0 | 58 | 21 |
| 10% | 0 | 59 | 40 |
| 20% | 0 | 92 | 91 |

Tests have demonstrated that the polystyrene products which penetrate the refractory coating during casting form a hydrophobic degradation product, in the presence of air, that is a partially oxidized polystyrene polymer with the oxygen incorporated largely in the hydrocarbon chain rather than the aromatic ring (i.e. a highly oxygenated alkyl chain with the attached phenyl groups remaining largely unmodified). The degradation product impedes wetting of the coating residue by the acid and retards the reaction between the acid and the acid-gasifiable compound (e.g. $CaCO_3$), by restricting access of the acid to the $CaCO_3$ in the coating residue. Hence, according to another aspect of this invention, the effects (i.e. reduced wetting of the coating residue) of the degradation products are neutralized to promote better wetting of the coating by the acid. In one embodiment, the degradation product is neutralized by adding a wetting agent or surfactant to the acid to promote wetting. According to a preferred embodiment, however, the casting is heated for a time and at a temperature sufficient to destroy the hydrophobic degradation product. The heat treatment may be accomplished quickly at high temperatures (e.g. 20 minutes @ 500° C.), or more slowly at lower temperatures (e.g. 17 hours @ 320° C.).

Various $CaCO_3$-containing coating mixtures were used in both laboratory (i.e. screen) and casting tests involving the present invention. The materials and processing parameters of these tests are listed in Table V. For mixtures based on commercial coatings, only $CaCO_3$ and water (for viscosity adjustment) were added. For experimental mixtures prepared with mica and $CaCO_3$ as refractory solids, a modified-cellulose binder and water were added. All coating mixtures were blended with mechanical stirring and subjected to vacuum for removal of entrained air before measurement of coating properties.

TABLE V

Materials for Lost-Foam Casting Trials With $CaCO_3$-Modified Coatings

| |
|---|
| Commercial coatings for polystyrene foam patterns |
| Styro Kote 400, Borden Chemical, Inc., contains: mica, quartz, clays, & vinyl acetate polymer |
| Ceramcote EP 9 AL 475, Ashland Chem. Co., contains: aluminum silicates, silica, acrylic & hydroxyethylcellulose polymers |
| Ceramcote EP 9 AL 530, Ashland Chem. Co., contains: mica, aluminum silicates, silica, & acrylic polymer |
| Ceramcote EP 9 AL 545, Ashland Chem. Co., contains: ceramic microspheres, iron oxide, aluminum silicates, & acrylic polymer |
| Other materials for preparing $CaCO_3$-modified coatings |
| $CaCO_3$, type CX0120 (mean particle size = 3 μm), EM Industries, Inc. |
| $CaCO_3$, type CX0110 (mean particle size = 30 μm), EM Industries, Inc. |
| Mica, type AMC-50, Ashville Mica Co. |
| Organic binders: hydroxyethyl cellulose (HEC), hdroxypropylmethyl cellulose (HPMC) & polyvinyl alchohol (PVA) |
| Acid bath for removal of coating residues |
| Phosphoric acid, 85% $H_3PO_4$, diluted 1:20 with water for use in acid bath |
| Non-ionic surfactants: Triton X-100, Rohm & Haas Co.; & Brij 35, Sigma Chem. Co. |
| Cationic surfactant: Hexadecyltrimethylammonium bromide, Sigma Chem. Co. |

Properties of the $CaCO_3$-containing coatings were compared to those of unmodified coatings by measuring the parameters customarily used for the testing of lost foam coatings. After measuring the viscosity of the coating slurry (Brookfield model DVII viscometer using the #3 disc spindle), circular wire test screens (2½ diam., stainless steel, 100 mesh) were coated by dipping. The screens were then dried (95° C. for 30 min.) before measurement of coating weight and the coating permeability. A sand permmeter (Dietert model No. 338), modified for use with the coated test screens, was used to determine the permeability of the coating to air.

Laboratory evaluations of the effectiveness of the $CaCO_3$modified coatings in removing the coating residues were also conducted using the coated wire screens. The screens were first covered with a layer of the liquid coating by dipping them into the coating suspension and drying before measuring coating weight and permeability. The coated screens were heated at a temperature of 500° C. for 20 minutes to remove the organic binder for the refractory and leave only the refractory solids. The screens were then immersed in dilute phosphoric acid, and the proportion of the coating removed was used as a measure of the ability of $CaCO_3$, in different coating formulations, to accelerate removal of the coating residue.

Thermogravimetric analysis (i.e. @ the 10° C./min heating rate) of coatings that had been infused with polystyrene revealed that in the presence of oxygen, both polystyrene and the organic binders, for the refractory begin to rapidly degrade and volatilize at temperatures between about 250° C. and 350° C. All of the organic binders volatilized at these temperatures, but the polystyrene degradation products (i.e. about 13% of the original polystyrene) survived, and persisted until the temperature exceeded 450° C. Temperatures as low as 320° C. are effective to remove the degradation products if sufficient time (i.e. many hours) is allowed for the process to go to completion. For these tests, the refractory solids from coating mixtures (prepared by drying in pans or on the wire screens) were infused with a solution of polystyrene dissolved in toluene (25% w/w). The toluene was removed by volatilization in a vacuum oven at about 80° C. The proportionate amount of polystyrene adsorbed on the coating solids (≈40% of coating weight) was similar to that which might be realized during casting. FIG. 1 shows the heat treatment, time-temperature relationships needed to remove the coating residue from the castings. Above the dashed line of FIG. 1, the coatings are readily removed when acid dipped. Below the dashed line, coating residue remains.

Formation of a heat-resistant polystyrene degradation product was also demonstrated using wire screens covered with $CaCO_3$-containing coatings which were similarly infused with polystyrene. When heated for 60 minutes at 350° C. in air, the coated screens infused with polystyrene turned to a medium dark brown color like that of the residues seen on castings. The reactivity in acid, and consequent extent of coating removal achieved with these screens in comparison to the screens without polystyrene products, are described in Table VI. FIG. 2 shows that $CaCO_3$-containing refractory coatings without polystyrene degradation products (the diamonds ◇) present can be readily removed when heat treated at much lower temperatures than the coatings that contained such degradation products (the squares □).

TABLE VI

Polystyrene Effect on Removal by Acid of Coating on Test Screens

| | | Percent of coating weight removed from test screen after immersion in acid bath | |
|---|---|---|---|
| Screen Coating | Heat Treatment | Ceramcoat "530" | Ceramcoat "545" |
| Control, No $CaCO_3$ | 350°/30" | 3% | 23% |
| With $CaCO_3$* | 350°/30" | 99% | 100% |
| *plus polystyrene | 350°/60" | 3% | 1% |
| *plus polystyrene | 1. 350°/60"<br>2. 500°/20" | 97% | 98% |

TABLE VI-continued

Polystyrene Effect on Removal by Acid of Coating on Test Screens

| Screen Coating | Heat Treatment | Percent of coating weight removed from test screen after immersion in acid bath: Ceramcoat "530" | Ceramcoat "545" |
|---|---|---|---|

*$CaCO_3$ content, w/w, 30% in "530" and 15% in "545": Polystyrene content, – + 25% of dried coating wt.

The results listed in Table VII compare the efficacy of two types of commercially available $CaCO_3$ mixed with two commercial coatings and an experimental coating prepared in the laboratory. A principle difference between the two forms of $CaCO_3$ was their respective mean particle size, which was approximately 30 microns for type CX0110 and 3 microns for type CX0120. The results using the two types of $CaCO_3$ were clearly dissimilar. The smaller particles of the type CX0120 $CaCO_3$ were very effective in each formulation, leaving no more than 0.2% of the coating on the screens. On the other hand, the larger particles of the type CX0110 $CaCO_3$ left significantly more of the coatings on the screens following the acid dip. The larger particle size of type CX0110 was also evidently responsible for increasing the permeability of the coating which can be an undesirable property for casting quality. The use of $CaCO_3$ with a small particle size is beneficial for both maintaining a low coating permeability and facilitating removal of the coating residue in the acid bath.

TABLE VII

Laboratory Screen Tests with $CaCO_3$-Modified Coatings

| Coating Mixtures | Initial Properties permeability, Dietert units | Coating Removed after 500° pyrolysis and acid bath immersion |
|---|---|---|
| Styro Kote 400, unmodified | 3.6 | 13% |
| +$CaCO_3$, type CX0110 (39% total solids) | 18.9 | 35% |
| +$CaCO_3$, type CX0120 (42% total solids) | 1.9 | 99.9% |
| Ceramcoat 475, unmodified | 13.3 | 7% |
| +$CaCO_3$, type CX0110 (41% total solids) | 41.3 | 88% |
| +$CaCO_3$, type CX0120 (45% total solids) | 6.4 | 99.9% |
| Experimental, solids = mica with 5% HEC | 70 | 98% |
| +$CaCO_3$, type CX0110 (32% total solids) | 147 | 99.6% |
| +$CaCO_3$, type CX0120 (32% total solids) | 13 | 99.8% |

Castings made using a $CaCO_3$-containing, experimental, clay-free coating to explore the effects of varying treatments on the subsequent reactivity with the acid bath. The results of these experiments are summarized in Table VIII, and demonstrate that heating the casting to about 500° C. quickly restores reactivity of the acid with the coating. Solvent washes appeared to have no effect. Heat treatment at the lower temperatures of 350° C. would be effective, but only after a prolonged treatment time (see FIG. 1). Accordingly, it was concluded that a post casting, oxidative heat treatment of at least about 450° C. is desirable to remove the hydrophobic residue from the coating in a commercially, reasonably time frame in order to render the coating more reactive in the acid dip station. Treatment time need only be sufficient to remove the hydrophobic residue, and will vary with treatment temperature and size of the casting. Hence, by way of example only, the head of an internal combustion engine requires about 20 minutes treatment time at 500° C. to remove the hydrophobic material.

TABLE VIII

Post-Casting Treatments of Casting with a $CaCO_3$-Modified Coating Residue

| Trial Treatments for Residue on Casting* | Consequent Effect in Acid Bath |
|---|---|
| Untreated | No reaction. |
| Heated to 500° C. for 20 min. | Complete reaction, all residue removed. |
| Heated to 350° C. for 20 min. | No reaction. |
| Solvent rinse with hexane | No reaction. |
| Solvent rinse with dichloromethane | No reaction. |
| Surfactant (1% Triton X-100) added to acid bath | Good, ≧90% of residue removed. |
| Surfactant (1% Brij 35) added to acid bath | Fair, ≧80% of residue removed. |
| Surfactant (1% hexadecyltrimethyl-ammonium bromide) added to acid bath | Fair, ≧80% of residue removed. |

*Trials conducted with casting made using an experimental coating containing 66% mica & 33% $CaCO_3$.

The efficacy of coating residue removal in an acid bath also shows a considerable variation with different commercial coatings. A $CaCO_3$ concentration of 10% in Ceramcote 545 was quite effective at promoting residue removal following the 500° C. post-casting thermal treatment. On the other hand, considerably higher concentrations were required for an equivalent effect with the other two coatings. A variety of $CaCO_3$-containing coatings were evaluated in casting trials, using three different commercial coatings and a range of $CaCO_3$ concentrations. Table IX summarizes the results of these evaluations.

TABLE IX

Casting Trials using $CaCO_3$-Modified Coatings

| Coating Type* | | Coating Residue Removal† reaction in acid bath: direct | after 500° C. | with surfactant |
|---|---|---|---|---|
| Ceramcote 530, | unmodified | None | Poor | — |
| | +10% $CaCO_3$ | — | Fair | — |
| | +20% $CaCO_3$ | None | Good | Poor |
| | +40% $CaCO_3$ | — | Complete | — |
| Ceramcote 545, | unmodified | None | Fair | — |
| | +10% $CaCO_3$ | None | Complete | — |
| | +20% $CaCO_3$ | Poor | Complete | Complete |
| Styro Kote 400, | unmodified | None | None | — |
| | +33% $CaCO_3$ | None | Good | Poor |
| Experimental, "clay-free" | | | | |
| 84% mica, 0.8% PVA, & 15% $CaCO_3$ | | — | Complete | Fair |
| 66% mica, 0.9% HPMC, & 33% $CaCO_3$ | | None | Complete | Good |
| 33% mica, 0.9% HPMC, & 66% $CaCO_3$ | | None | Complete | Good |

*Content of $CaCO_3$, mica, and binders expressed as percent of total solids
†Estimate of residue removed: none = little or no reaction, poor = <75%, fair = 80–85%, good = 90–95%, & complete = 100%.

Tests were also conducted on the effectiveness of adding surfactants to the acid bath to neutralize the affects of the styrene degradation products and accelerate removal of the $CaCO_3$-containing coating residue. A non-ionic surfactant (i.e. triton X-100), and a quaternary ammonium surfactant, were tested separately in a concentration of 1% by volume of the acid bath, and exhibited considerable success with the experimental "clay-free" coatings containing primarily mica, $CaCO_3$ and a modified cellulose binder, and lesser success with $CaCO_3$-containing Ceramcote 545.

While the invention has been disclosed in terms of certain specific embodiments thereof, it is not intended to be limited thereto but rather only to the extent set forth hereafter in the claims which follow.

What is claimed is:

1. In the process for the lost foam casting of aluminum comprising the principle step of forming a pattern from a polymeric foam, depositing a refractory coating on the surface of said pattern, embedding said pattern in a bed of sand that forms a mold about said pattern, pouring molten aluminum into said mold to vaporize and displace said pattern, replicate said pattern with said aluminum and coat said aluminum with said coating, allowing said aluminum to solidify into a casting, and removing said sand from said casting, the improvement comprising said coating comprising a sufficient amount of a thermally stable, water insoluble, acid-gasifiable compound to rupture said coating upon gasification, and wetting said coating with an acid to dissociate and gasify said compound and rupture said coating.

2. The process according to claim 1 wherein said gasifiable compound is selected from the group consisting of alkaline earth carbonates.

3. The process according to claim 2 wherein said alkaline earth carbonate is calcium carbonate.

4. The process according to claim 3 wherein said calcium carbonate has an average particle size less than about 5 microns.

5. The process according to claim 3 wherein said calcium carbonate comprises at least about 10% by weight of said coating.

6. The process according to claim 1 wherein, while hot, said casting is quenched in an acidic aqueous quenchant.

7. The process according to claim 1 including the step of neutralizing any thermal degradation products of said foam left in said refractory coating to enhance said wetting.

8. The process according to claim 7 including adding a surfactant to said acid to effect said neutralizing.

9. The process according to claim 7 including the step of heating said casting sufficiently to remove said thermal degradation product to effect said neutralizing.

10. A process for the lost foam casting of aluminum comprising the steps of:

(1) forming a pattern from a polymeric foam;

(2) depositing refractory coating comprising a thermally stable, acid-gasifiable, water-insoluble compound on the surface of said pattern;

(3) embedding said pattern in a bed of sand that forms a mold about said pattern;

(4) pouring molten aluminum into said mold to vaporize and displace said pattern, replicate said pattern with said aluminum, coat and infuse said coating with hydrophobic thermal degradation products of said foam;

(5) allowing said aluminum to solidify into a casting;

(6) removing said sand from said casting;

(7) heating said casting for a time and at a temperature sufficient to remove said hydrophobic breakdown products from said coating; and (8) contacting said coating with an acid to dissociate and gasify said compound and rupture said coating.

11. The process according to claim 10 wherein said foam comprises polystyrene and said temperature is at least about 450° C.

12. The process according to claim 10 wherein said acid-gasifiable compound comprises an alkaline earth carbonate.

13. The process according to claim 12 wherein said compound comprises calcium carbonate.

* * * * *